United States Patent [19]

Parsons et al.

[11] Patent Number: 4,813,201

[45] Date of Patent: Mar. 21, 1989

[54] PLATFORM SYSTEM

[75] Inventors: Philip L. Parsons; Ewart Richardson, both of London, Great Britain

[73] Assignee: P. L. Parsons & Company, Ltd., United Kingdom

[21] Appl. No.: 28,305

[22] Filed: Mar. 20, 1987

[51] Int. Cl.[4] ..... E04H 3/26

[52] U.S. Cl. ..... 52/7; 52/263; 108/64; 108/156

[58] Field of Search ..... 52/263, 637, 7, 79.1; 248/188, 188.5, 677, 649; 108/156, 56.3, 64, 155, 151, 54.1; 182/178; 403/3, 104, 383, 109, 362

[56] References Cited

U.S. PATENT DOCUMENTS

| | | | |
|---|---|---|---|
| 2,403,338 | 7/1946 | Butler | 108/64 |
| 3,207,095 | 9/1965 | Hiatt, Jr. | 108/54.1 X |
| 3,856,112 | 12/1974 | Stewart | 182/106 X |
| 3,875,712 | 4/1975 | Thompson | 52/263 |
| 4,216,933 | 8/1980 | Cramer | 248/188.5 |
| 4,577,449 | 3/1986 | Celli | 248/218.4 X |

*Primary Examiner*—Carl D. Friedman

*Attorney, Agent, or Firm*—Ostrolenk, Faber, Gerb & Soffen

[57] ABSTRACT

A platform system, in particular for providing staging, which consists of a number of platform units each of which comprises a flat platform having on the underside thereof hollow posts of square cross-section for receiving tubular legs of circular cross-section for supporting the platform. The legs of the respective platform units may be different heights to give a variable height system. Also the legs may be suitably bent to provide a raked platform.

10 Claims, 3 Drawing Sheets

PLATFORM SYSTEM

BACKGROUND OF THE INVENTION

1. Field of the Invention

This invention relates to a platform system, in particular for staging units. Such units are commonly used in the entertainment industry (theatres, studios, concert halls etc). The platform system of the invention may however find wider application, particularly in the building industry.

2. Description of the Prior Art

The oldest and most commonly used form of staging, at least in the United Kingdom, is the timber framed folding gate rostrum. This however has the disadvantage of being a fixed height, and also (above a height of about 2'0) is heavier than the platform system of the present invention; it is also more easily damaged, and does not stack well.

Apart from methods with many discrete elements, such as scaffolding, or simple beam and post grid assemblies, there are two known other systems. The first of these is a collapsible system which is the subject of German patent No. DE-147507. This is however known to be vulnerable to accidental damage, and is also very expensive. The same manufacturer also produces the second system, which involves complex aluminium extrusions to form the frame members, and uses simple square plug-in legs which are available only from the manufacturer, and are very expensive. These units are much less strong than the platform system of the present invention which is described below; also considerably less robust, and more expensive. Because the legs are so slender the height limit is only about 1.000 m, and bracing is not available to extend this.

The leg is secured to the top in a simple aluminium casting secured with a wing nut. Because it is so shallow the unit cannot approach the degree of strength in use or in handling offered by the platform system of the present invention.

SUMMARY OF THE INVENTION

The present invention provides a platform system comprising at least one unit each comprising a substantially flat platform having on the underside thereof downwardly extending hollow posts of square cross-section, and legs of circular cross-section insertable into said posts to provide a platform of variable height and angle of rake.

The platform system of the invention is most preferably a staging unit comprising a rigid fabricated metal frame (at present made in mild steel) having a flat top of sheet material (usually plywood), and square corner posts; it may also have intermediate posts.

It is used in conjunction with legs of scaffold tube inserted into the posts to provide staging of variable height or angle of rake. The posts therefore join the sides of the frame, and also secure the legs. The round tubular legs are preferably held into the square posts by tightening a bolt (which passes through a nut welded onto the corner of the post) so that it drives the leg against the two opposing inner faces of the post.

Scaffold tube is steel or aluminium round tube having a substantial wall thickness, and an outer diameter of approximately 48.5 mm.

The frame joining the posts may be of conventional truss design, and is at present made from rectangular ERW MS tube $1\frac{1}{2}'' \times \frac{3}{4}'' \times 16$ g wall, $\frac{3}{4}'' \times \frac{3}{4} \times 16$ g wall and 8 mm diameter MS rod.

The posts are suitably lengths of SHS mild steel 60 mm×60 mm×5 mm wall, closed at the top with a welded metal plate, at present a 3 mm square plate washer having a center hole of 13 mm diameter.

The top members of the frame are drilled to permit adjacent frames to be bolted together, and the drill holes are reinforced with square plate washers welded onto the inside face of the tubes.

The tops are mostly commonly $\frac{3}{4}''$ thick plywood which has underfelt glued to its lower surface. This plywood is fixed to the steel frame either directly with large head self-tapping screws, or with machine screws which locate with threaded inserts in the top tube of the frame.

The scaffold legs may be fitted with plastic inserts of commercial origin to protect the floor surface.

Castors suitably of the type made for the scaffolding industry may be fitted to the platform system simply by insertion into the corner posts.

This design of staging has the advantage of being extremely versatile, tough, strong and relatively cheap. It requires only a simple spanner to use, and needs no particular skill in erection.

DESCRIPTION OF THE PREFERRED EMBODIMENTS

The invention will be further described, by way of example only, with reference to the accompanying drawings, in which.

Figure 1:
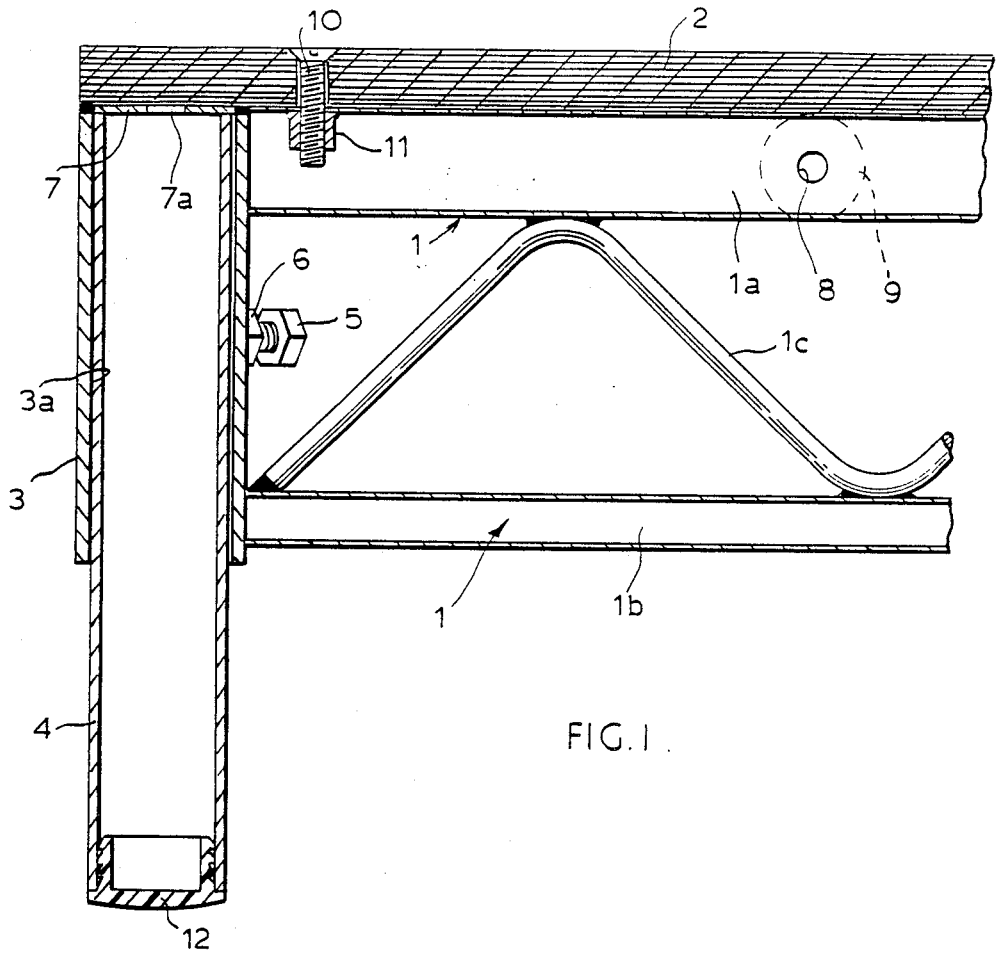
FIG. 1 is a detailed vertical section of a part of a platform system of the invention.
Figure 2:
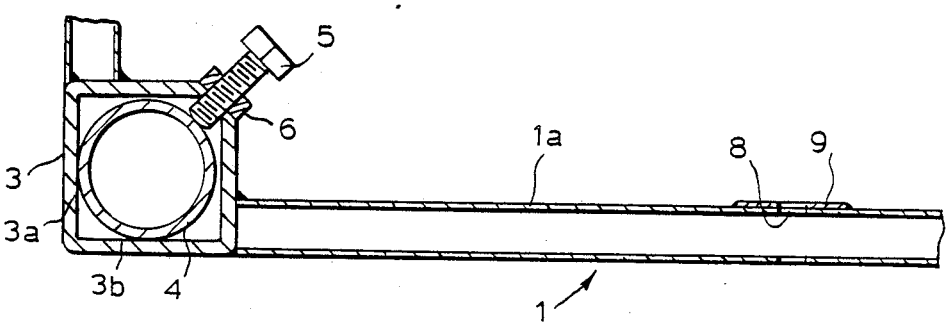
FIG. 2 is a horizontal section corresponding to FIG. 1.

FIGS. 1 and 2 show a platform system which consists of a number of rectangular staging units, each unit comprising a rigid fabricated metal frame 1 of mild steel having a flat top 2 of plywood sheet and, at each of its four corners (only one of which is shown), a corner post 3 of square cross-section. The posts 3 join the sides of the frame 1.

The platform is provided at each of its four corners with a leg 4 of scaffold tube which are inserted into the posts 3. The tubular legs 4 are held in the posts 3 in each case by tightening a bolt 5 which passes through a nut 6 welded onto the corner of the post so that it drives the leg 4 against the two opposing inner faces 3*a*, 3*b* (see FIG. 2) of the post 3. The scaffold tube of which the legs 4 are formed is of steel or aluminium round tube.

The frame 1 joining the posts 3 is of conventional truss design. Upper and lower tubular parts 1a and 1b of the frame are connected by an undulating tubular part 1*c* welded to the parts 1*a* and 1*b*. The tubular part 1*a* is of rectangular section, the part 1*b* of square section, and the part 1*c* of circular section.

The posts 3 are of mild steel, and are each closed at the top with a welded metal plate in the form of a square plate washer 7 having a center hole 7*a*

The top members of the frame are drilled to permit adjacent frames to be bolted together. FIG. 2 shows such a drill hole 8 reinforced with a square plate washer 9 welded onto the inside face of the frame.

The flat top 2 of the frame 1 is thick plywood which preferably has underfelt glued to its lower surface. The plywood top is fixed to the steel frame 1 either directly with large head self-tapping screws, or with machine screws 10 which locate with threaded inserts 11 in the top tube of the frame.

The legs 4 are fitted with plastic inserts 12 to protect the floor surface.

Figure 3:
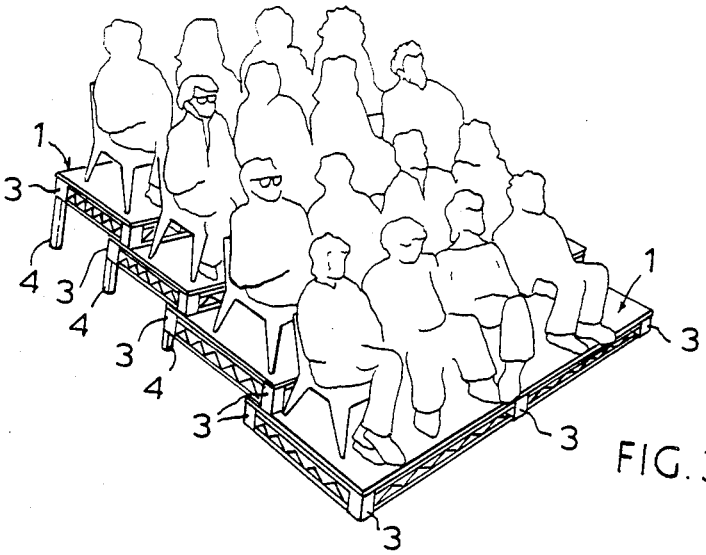
FIG. 3 shows an erected platform system of the invention, for audience seating.

FIG. 3 shows an erected platform system, wherein tiers of standard 8'×4' decks provide stable, easily erected audience seating platforms. As shown, the legs of the respective platform units are of different height to give a variable height system.

The strength of the standard deck is considerable yet the weight (at 33.6 kilos) is 2 kilos less than an 8'×4"×18" conventional folding gate rostrum.

Figure 4:
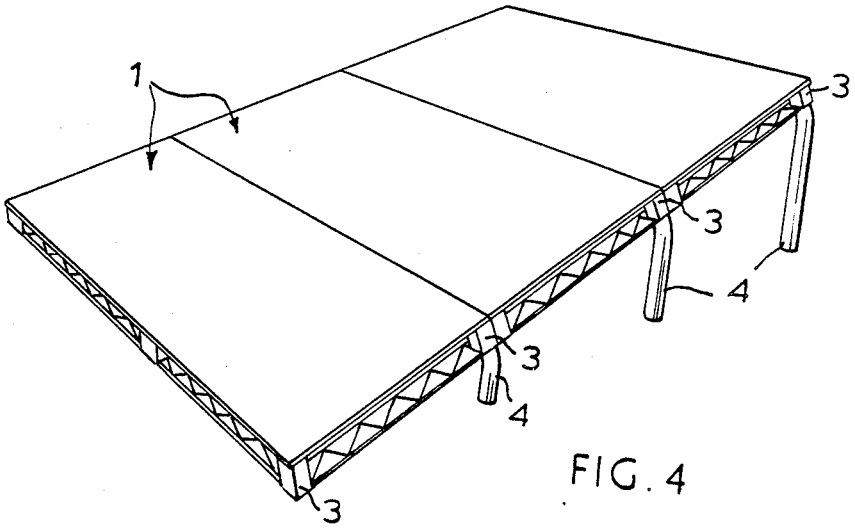
FIG. 4 shows a platform system of the invention erected as a raked stage.

As shown in FIG. 4, a raked stage may be achieved by bending the tubular legs 4.

Figure 5A:
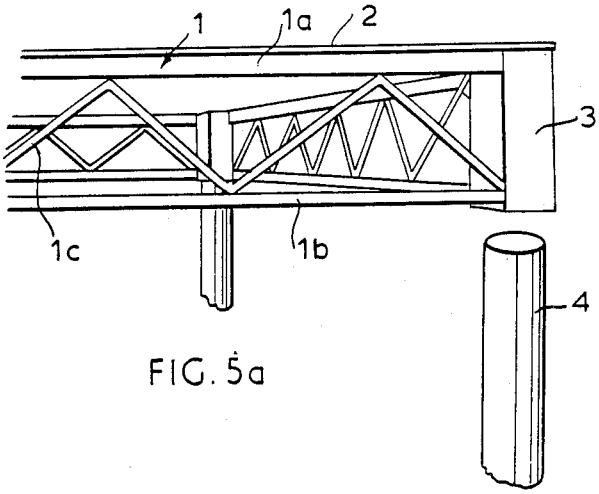
FIGS. 5(*a*), (*b*) and (*c*) show the manner of insertion of a leg into a corner post of a platform system of the invention.
Figure 5B:
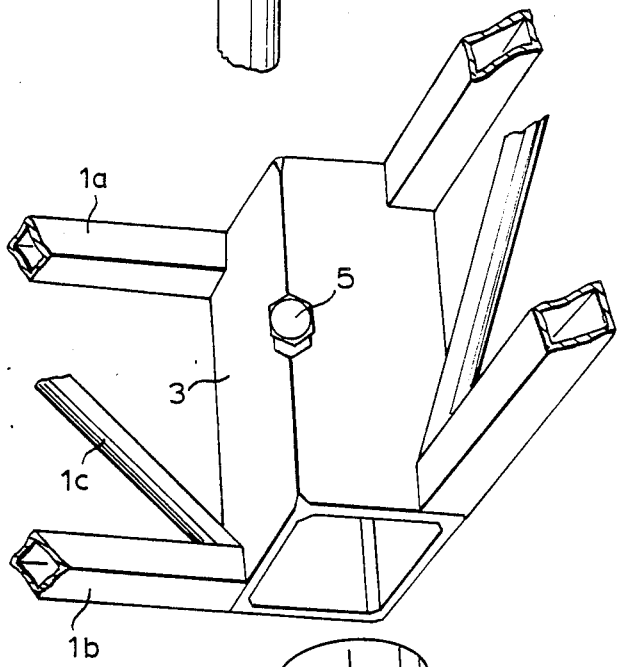
Figure 5C:
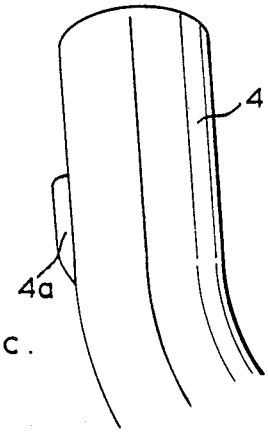

FIG. 5 illustrates the member of erection of the platform system, wherein FIG. 5(*a*) shows a leg 4 about to be inserted into a corner post 3 of a frame 1 of a platform, FIG. 5(*b*) is detailed view of the corner post 3, and FIG. 5(*c*) shows a bent leg 4 (provided with a locating lug 4*a*) which may be used to provide a raked stage. Once the leg 4 has been inserted into the post 3, the retaining bolt 5 is tightened to firmly secure the upper part of the leg within the post.

We claim:

1. A staging system comprising:

at least one unit; each unit comprising a substantially flat platform in the form of a rigid fabricated metal frame and having a flat top of sheet material;

the platform having an underside; downwardly extending hollow posts of square cross-section extending down from the underside of the platform; the hollow posts having an upper end and a plate over and closing the upper end of each post;

legs of circular cross-section insertable into the hollow posts up to the plate; and means for releasably securing the legs within the posts.

2. The staging system according to claim 8, which comprises at least one rectangular staging unit each comprising a rigid fabricated metal frame having a flat top of sheet material, and having said posts at least at each of its four corners.

3. The staging system according to claim 2, wherein the platform is raked.

4. The staging system according to claim 1, further comprising bolts insertable into the posts for securing said legs within said posts.

5. The staging system according to claim 1, wherein the legs of the respective platform units are of different heights whereby there may be obtained a platform system of variable height.

6. The staging system according to claim 1, wherein the flat platforms are drilled to permit adjacent platforms to be bolted together, and wherein the drill holes are reinforced with plate washers.

7. The staging system according to claim 1, wherein the flat platforms comprise a steel frame, and plywood sheeting having underfelt adhered to its lower surface fixed to said steel frame.

8. A staging system comprsing:

at least one unit; each unit comprising a substantially flat platform in the form of a rigid fabricated metal frame and having a flat top of sheet material;

the platform having on an underside downwardly extending hollow posts of square cross-section;

legs of circular cross-section insertable into the hollow posts; means for releasably securing the legs within the posts; and wherein the legs are bent along their lengths.

9. The staging system according to claim 8, wherein the platform is raked.

10. The staging system according to claim 8, wherein the system comprises at least one rectangular staging unit each comprising a rigid fabricated metal frame having a flat top of sheet material, and having the posts at least at each of its four corners.

* * * * *